US005273201A

United States Patent [19]

Hambrecht

[11] Patent Number: 5,273,201

[45] Date of Patent: Dec. 28, 1993

[54] TURNING BAR FED BY COMPRESSED AIR FOR TURNING OVER WEBS IN ROTARY PRINTING PRESSES

[75] Inventor: Dieter Hambrecht, Sandhausen, Fed. Rep. of Germany

[73] Assignee: Heidelberger Druckmaschinen AG, Heidelberg, Fed. Rep. of Germany

[21] Appl. No.: 888,195

[22] Filed: May 26, 1992

[30] Foreign Application Priority Data

May 25, 1991 [DE] Fed. Rep. of Germany ..... 4117094

[51] Int. Cl.[5] ..... B65H 23/32

[52] U.S. Cl. ..... 226/197; 101/228; 34/156; 226/199

[58] Field of Search ..... 226/7, 97, 196, 197, 226/199; 34/156; 101/228

[56] References Cited

U.S. PATENT DOCUMENTS

| | | | |
|---|---|---|---|
| 2,941,062 | 6/1960 | Halley | 34/160 X |
| 3,553,848 | 1/1971 | Kuroki et al. | 34/156 X |
| 3,599,851 | 8/1971 | Hedlund et al. | 226/197 X |
| 3,679,116 | 7/1972 | Hamlin et al. | 226/197 |
| 4,043,495 | 8/1977 | Sander | 226/197 |
| 4,197,002 | 4/1980 | Hamaker et al. | 226/97 X |
| 4,453,465 | 6/1984 | Heller et al. | 226/197 X |

FOREIGN PATENT DOCUMENTS

| | | | |
|---|---|---|---|
| 0718782 | 9/1965 | Canada | 226/197 |
| 3436870 | 5/1986 | Fed. Rep. of Germany . | |
| 0280782 | 11/1927 | United Kingdom | 226/197 |
| 1070201 | 6/1967 | United Kingdom | 226/197 |

*Primary Examiner*—Daniel P. Stodola
*Assistant Examiner*—Paul T. Bowen
*Attorney, Agent, or Firm*—Herbert L. Lerner; Laurence A. Greenberg

[57] ABSTRACT

A compressed air-fed turning bar assembly for turning over printed webs of material includes a cross member, a bearing body displaceably disposed on the cross member, at least one turning bar secured to the bearing body and displaceable therewith on the cross member, the turning bar having a circumference formed with air-outlet openings, at least one actuating spindle mounted in the turning bar and having an air duct, and a piston displaceably mounted on the actuating spindle and having an outer cylindrical surface formed with air outlet openings disposed in rows of different length extending in axial direction of the piston.

7 Claims, 3 Drawing Sheets

TURNING BAR FED BY COMPRESSED AIR FOR TURNING OVER WEBS IN ROTARY PRINTING PRESSES

The invention relates to a turning bar fed by compressed air for turning over webs in rotary printing presses.

German Patent 34 36 870 discloses a turning bar circumcirculated by air for rotary printing presses. The turning bar carries two pistons on a profile, the pistons respectively having a tube-shaped projection with an outer end face beveled in accordance with the course of a paper-web edge guided on and around the outside of the turning bar. Two threaded spindles, which are lockable in the turning bar, serve for displacing the pistons in the turning bar.

The turning bar, is mounted in fixed position through the intermediary of a bracket, and is additionally subjected to compressed air through the intermediary of the bracket. Consequently, the turning bar can be adjusted only by rotating internal structural units. The piston-guiding threaded spindles are adjusted manually by means of knurled screws which, in order to be operated on or actuated, require the pressmen to climb into the superstructure. The tube-shaped projections, which are completed from an isosceles or equilateral triangle, are difficult to fit into the turning bar because, for reasons of maximum possible sealing, the outer diameter thereof must be the same as the inner diameter of the turning bar, with a slight amount of undersizing.

It is accordingly an object of the invention to provide an optimized turning bar which, for a multiplicity of possible web-guide variations, respectively, assures a precise metering of an air cushion in accordance with the width of the web.

With the foregoing and other objects in view, there is provided, in accordance with the invention, a compressed air-fed turning bar assembly for turning over printed webs of material, comprising a cross member, a bearing body displaceably disposed on the cross member, at least one turning bar secured to the bearing body an displaceable therewith on the cross member, the turning bar having a circumference formed with air-outlet openings, at least one actuating spindle mounted in the turning bar and having an air duct, and a piston displaceably mounted on the actuating spindle and having an outer cylindrical surface formed with air outlet openings disposed in rows of different length extending in axial direction of the piston.

Advantages of the invention are that the displaceability of the turning bar permits automatic positioning of the turning bar as part of the presetting operation. The air feed or supply inside the actuating spindles of the turning bar permits the build-up of a uniform air cushion. The precision of the air control at the edges of the turning bar, in accordance with the edges of the web, is improved by the rows of air-outlet openings, and the energy output of the air-pressure source can be reduced, because, in addition, the air losses are negligible due to accurate piston guidance. Furthermore, lower-cost manufacture of the pistons is possible.

In accordance with another feature of the invention, the rows of air-outlet openings formed on the outer cylindrical surface of the piston are laterally offset with respect to one another in accordance with respective edges of a web of material slung around the turning bar.

This ensures precise air metering, especially in the edge regions of the web which is being guided.

In accordance with a further feature of the invention, there is provided an electric motor connected to the actuating spindle for driving the spindle, the electric motor having a potentiometer. It is thereby possible, when a printing-job change occurs, to incorporate the control of the turning bar within the framework of the presetting operation. It is possible, on a job-specific basis, to store data regarding turning-bar positions which have been found to be satisfactory. For the next comparable printing job, these turning-bar positions can be automatically assumed as part of the presetting operation.

In accordance with an added feature of the invention, there is provided a closed channel system for feeding compressed air into the interior of the turning bar, the closed channel system having an approximately identical cross-sectional area over the length thereof. This permits a streamlined feed of the compressed air, because flow resistances are markedly minimized in order to ensure a least possible loss in the transport of the compressed air and in order to prevent leaks. The channel or duct system which is provided dispenses with any need for interfering systems of lines outside of the cross-members and turning bars which would otherwise restrict the web-guiding possibilities.

In accordance with an additional feature of the invention, there are provided means for building up an air cushion by discharging air from the air duct of the actuating spindle starting from the middle of the turning bar. This facilitates a precise build-up of an air cushion uniformly across the width of the web.

In accordance with yet another feature of the invention, the bearing body has a device for finely adjusting the angular position of the turning bar.

In accordance with a concomitant feature of the invention, the fine-adjusting device comprises an eccentric shaft, and an eccentric movable by the eccentric shaft in a chamber formed in the bearing body, the bearing body comprising an actuating lug and a bearing plate, the actuating lug being displaceable by the eccentric shaft relative to the bearing plate. The fine adjusting device permits positional corrections of the angular position of the turning bar so as to ensure optimum running or travel of the web.

Other features which are considered as characteristic for the invention are set forth in the appended claims.

Although the invention is illustrated and described herein as embodied in a turning bar fed by compressed air for turning over webs in rotary printing presses, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
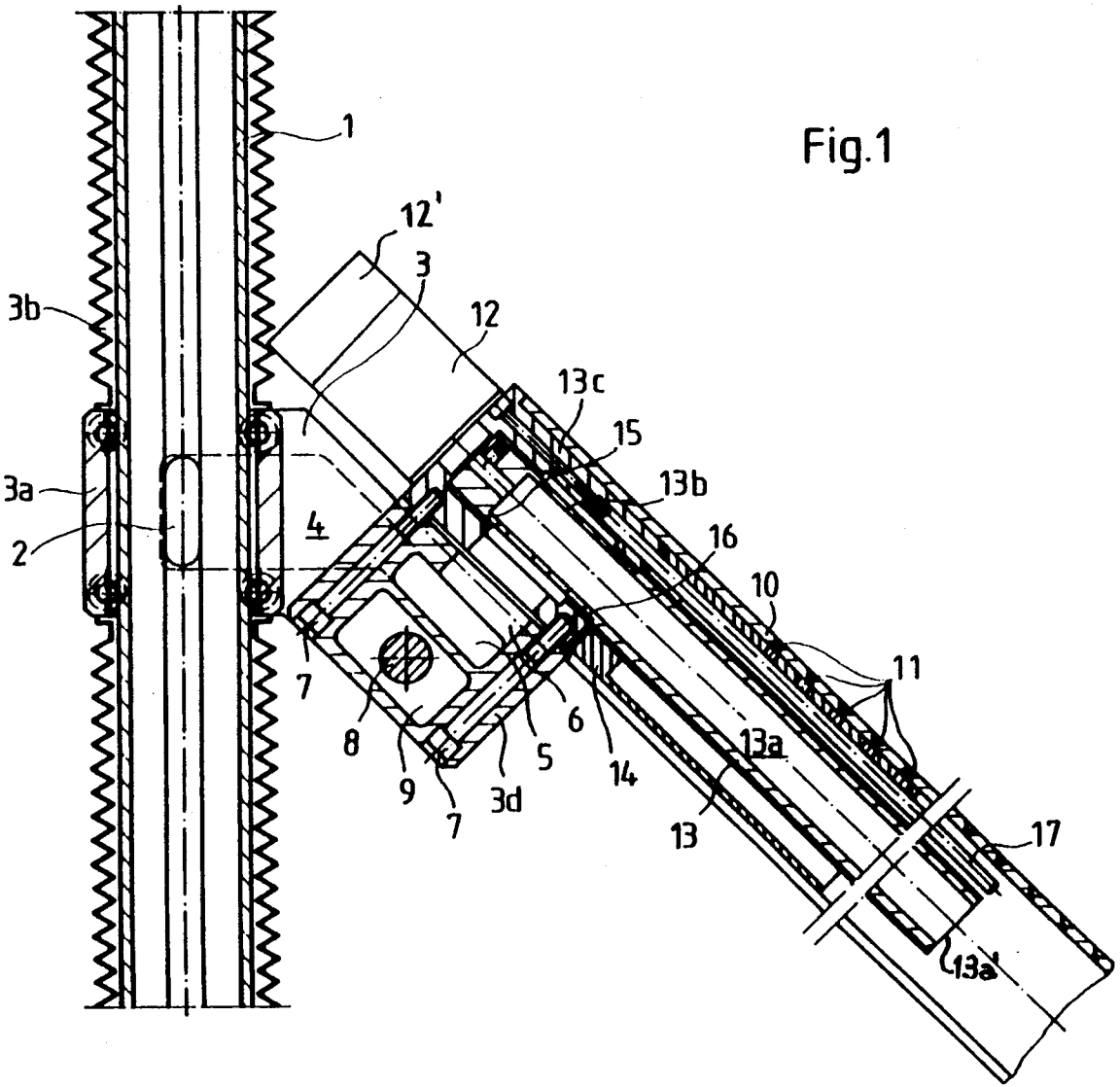
FIG. 1 is a fragmentary longitudinal sectional view of a traverse or cross member holding one end of a turning bar, in the interior of which a compressed-air feed system is provided.

Referring now to the drawings and, first, particularly to FIG. 1 thereof, there is shown therein one end of a turning bar 10 held on a cross member 1, the interior of the turning bar end including a compressed-air feed system. A compressed-air conducting traverse or cross member 1 mounted in an otherwise non-illustrated turning-bar superstructure is formed with a channel through which compressed air flows through an outlet opening 2 into a bearing body 3. The bearing body 3 is fastened to a slide member 3a by means of which it travels on the cross-member 1, a bellows 3b being provided for sealing the compressed air in. The bearing body is further provided with a bearing plate 3c and an actuating lug 3d. The compressed air is fed from the outlet opening 2 into a cavity 4, from which it passes into an air chamber 5. From the air chamber 5, the air flows through an opening 6 into a bearing 13c for an actuating spindle 13. The compressed air enters through a bore 13b formed in the actuating spindle 13, into an air duct 13a provided in the actuating spindle 13. Approximately in the vicinity of the center or middle of the turning bar 10, i.e. approximately in the region of the turning bar 10 located at the bottom right-hand side of FIG. 1, the compressed air escapes from an end opening 13a' of the air duct 13a into the interior of the turning bar 10. Disposed opposite the actuating spindle 13 illustrated in FIG. 1 is a similar non-illustrated actuating spindle 13 which is located at the other non-illustrated end of the turning bar 10.

The actuating lug 3d of the bearing body 3 is secured by two retaining screws 7 to the actuating-spindle bearing 13c, which is disposed within the turning bar 10. Air-outlet openings 11 are formed in rows on the circumferential or peripheral surface of the turning bar 10. An electric motor 12 provided with a potentiometer 12' is connected to and sets the actuating spindle 13 into rotation. A piston 14 is accordingly moved in axial direction on the actuating spindle 13. The piston 14 is maintained in the circumferential disposition thereof by a guide 17 fixed in the actuating-spindle bearing 13c. The rotation of the actuating spindle 13 by the electric motor 12 is assured by sliding or journal bearings 15 and 16, which are installed between the actuating-spindle bearing 13c and the actuating spindle 13.

With the actuating spindle 13 in rotation and with the compressed-air supply switched on, compressed air passes through the hereinaforedescribed duct or channel system into the air duct 13a of the actuating spindle 13 and escapes through the air-outlet openings 11 located in the middle of the turning bar 10. The rotation of the actuating spindle 13 causes the displacement of the piston 14 towards the center or middle of the turning bar 10 so that the air-outlet openings 11 formed in the turning bar 10 and located closest to the electric motor 12 are cut off from the air supply. The piston 14 which is cup-shaped serves simultaneously as a seal with respect to the inner wall surface of the turning bar 10, so that no leakage air can escape, and it is thereby possible to reduce the energy output required for providing the compressed air.

Figure 2:
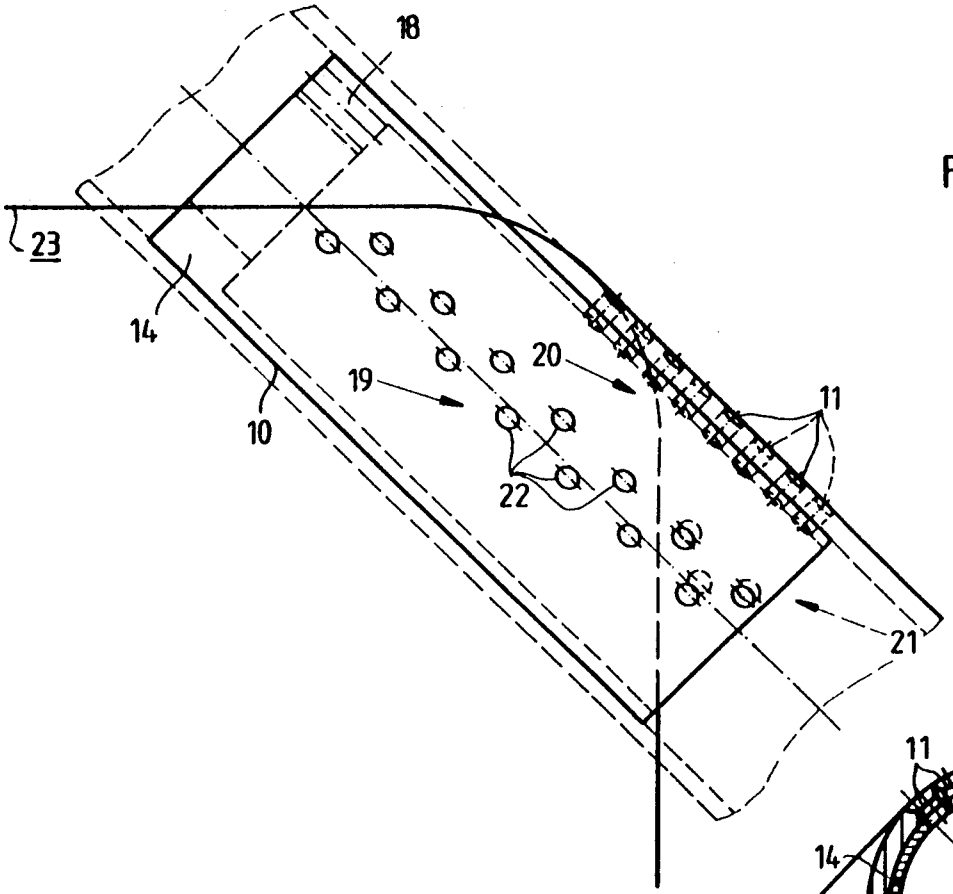
FIG. 2 is an enlarged fragmentary longitudinal view of FIG. 1 showing a piston formed with rows of air-outlet openings within the turning bar.

FIG. 2 shows the arrangement of the rows of air-outlet openings on the piston 14 and on the turning bar 10. When the piston 14 has moved along the actuating spindle 13 and the guide 17 of FIG. 1 into a defined position, it assumes the position shown in FIG. 2. A web of material 23, shown by the solid line as running from above onto the turning bar 10, runs over a first row 19 of air-outlet openings 22. In the interest of clarity, only one row of air-outlet openings 11 is shown formed in the turning bar 10. The extent of the generated air cushion laterally on the circumference or periphery of the turning bar 10 is limited by the two air-outlet openings 22 of the row 19 thereof lying closest to the edge of the web of material 23. The air-outlet openings 11 of the turning bar 10 corresponding to the row 19 of the piston 14 are disposed precisely above the air-outlet openings 22 as shown in the cross-sectional view of FIG. 2a. If the progress of the web of material 23 is followed along the circumference of the turning bar 10, the web of material 23 then meets with air-outlet openings 11 formed in the turning bar 10, a number of which extending as far as the edge of the web of material 23 being opened to a flow of the compressed air therethrough by a row 20 of the openings 22 formed on the piston 14. The rows 19, 20 and 21 of the air-outlet openings 22 formed on the piston 14 and the rows of air-outlet openings 11 formed on the circumference of the turning bar 11 are offset 90° with respect to one another.

Figure 2A:
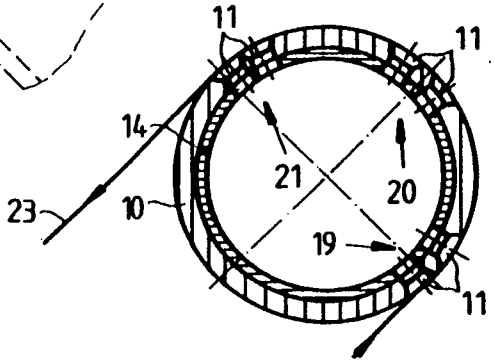
FIG. 2a is a cross-sectional view of FIG. 2.

In the illustrated embodiment of FIGS. 2 and 2a, the row 21 located opposite the row 19 on the piston 14 is formed of three air-outlet openings 22 represented by broken lines in FIG. 2. The edge of the turned-over web of material 23 is thus subjected to compressed air so that it cannot deposit on the circumference of the turning bar 10.

All of the air-outlet openings 11 of the turning bar 10 lying between the illustrated piston 14 and the non-illustrated similar piston at the other non-illustrated end of the turning bar 10, are, of course, subjected to compressed air. By the use of electric motors 12 at the two opposite ends of the turning bar 10 it is also possible to move just one piston 14, respectively, in the turning bar 10. This permits the air cushion to be limited to specific regions of encirclement or looping on the turning bar 10. The air-outlet openings 11 and 22, respectively, although shown to be in the form of circular bores, may also be formed as slits or may have a different geometrical form.

By providing the electric motors 12 with potentiometers 12', it is possible to indicate or display at the control console of the printing press the positions of the pistons 14 on the actuating spindles 13. Once these data are stored, the pistons 14 ca be moved to the desired positions by merely pressing a button when repeat printing jobs are called for.

Figure 3A:
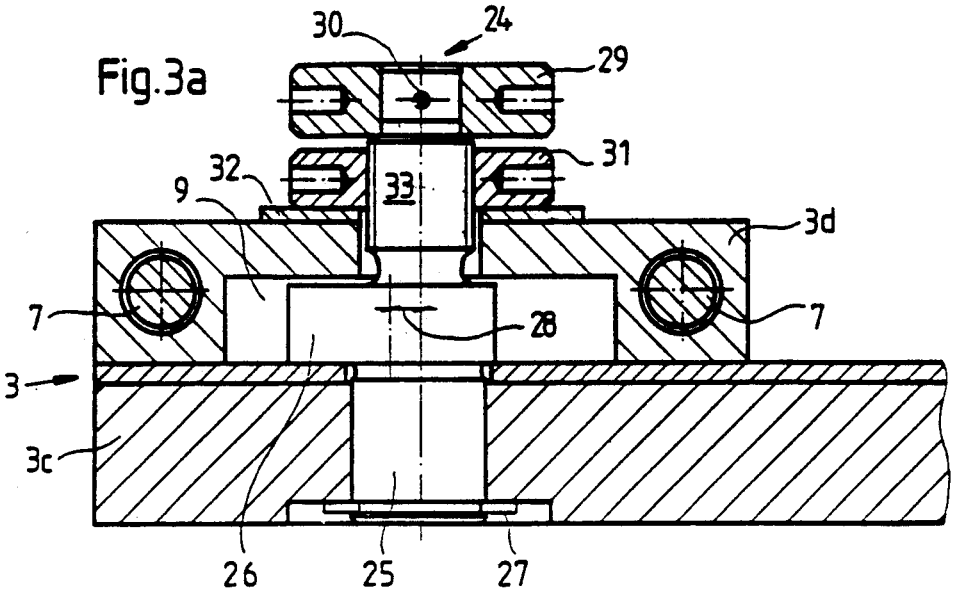
FIG. 3a is a cross-sectional view of a device for finely adjusting the angular position of the turning bar.
Figure 3B:
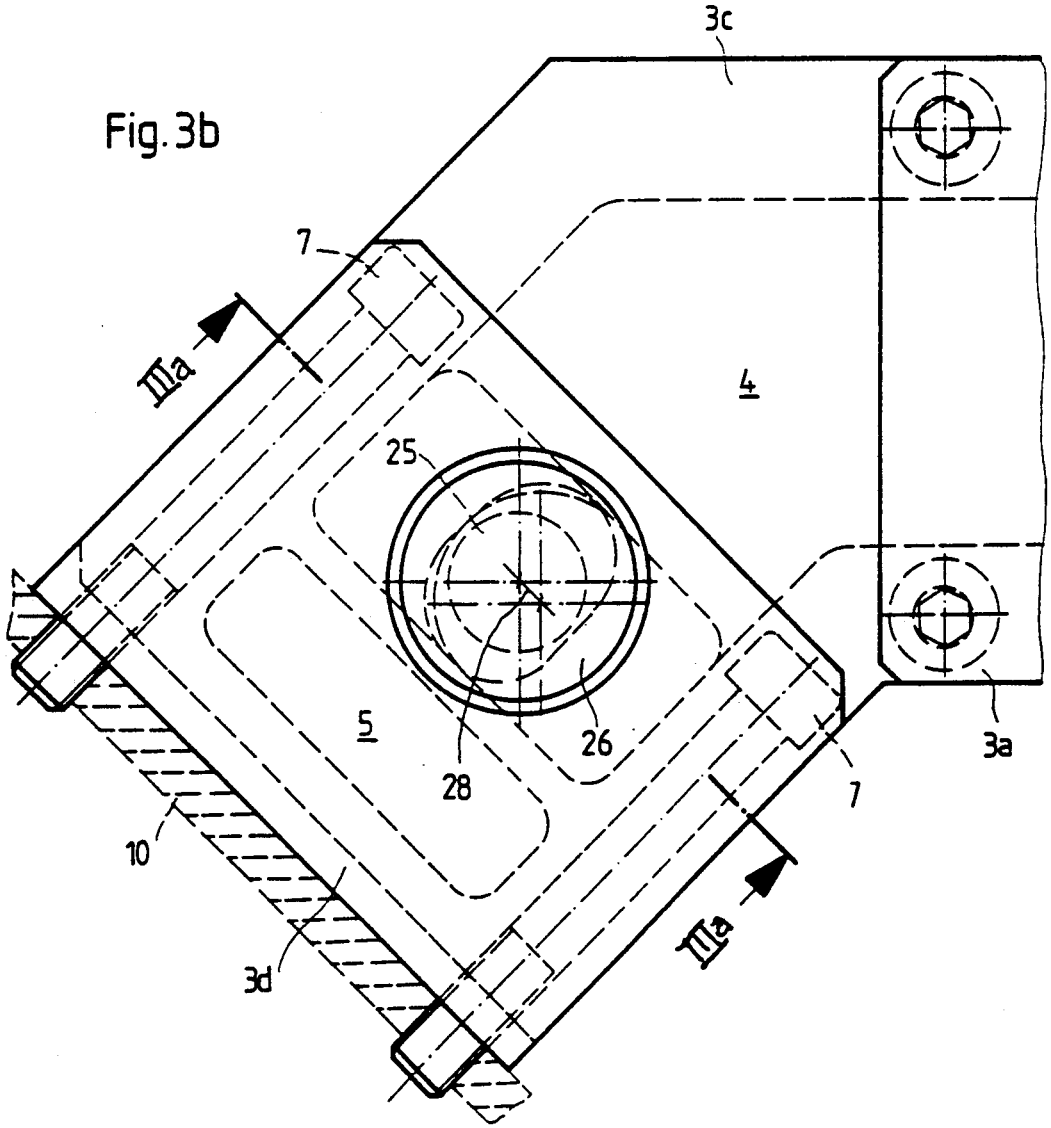
FIG. 3b is a plan view of the adjusting device of FIG. 3a, the cross-sectional view of which is taken along the line IIIa—IIIa in the direction of the arrows.

FIGS. 3a and 3b illustrate a device for finely adjusting the angular position of the turning bar in respective cross-sectional and top plan views.

It is believed to be readily apparent from the cross-sectional view of the fine-adjusting device 24 shown in FIG. 3a that, by means of a clamping nut 31 and a snap ring 27, an eccentric shaft 25 connects the bearing plate 3c and the actuating lug 3d of the bearing body 3 to one another so that they are movable with respect to one another. On the eccentric shaft 25, an eccentric 26 is provided which has an eccentricity 28 with reference to the axis of symmetry of the eccentric shaft 25. When the eccentric shaft 25 is rotated by an actuating element 29, the eccentric 26 moves along the inner limiting walls of a chamber 9. The position of the actuating lug 3*d* is accordingly shifted with respect to the bearing plate 3*c* of the bearing body 3. Because the actuating lug 3*d* is connected to the turning bar 10 through the intermediary of the two retaining screws 7, the movement of the bearing lug 3*d* with respect to the bearing plate 3, which is displaceably mounted on the cross-member 1, permits rotation about the axis of rotation of this end of the turning bar 10 with respect to the end of the turning bar 10 shown in FIG. 1. This rotation, which is only through a few angular degrees in one rotary direction or the other, permits a fine adjustment of the turning bar 10, for example, in order to prevent the undesired occurrence of "water bags".

If there is a change in humidity, or a change in setting parameters of cooling rollers or driers occurs, it may be necessary to adjust the position of the turning bar 10. On the one hand, the actuating element 29 can be operated in a fine and delicate manner by experienced pressmen, yet, on the other hand, it is also conceivable that an electric-motor drive may be provided, with which a feedback of the adjusting position may occur. It is also possible to employ pneumatic cylinders or electromagnets. In order to transmit the rotational movement of the actuating element 29 to the eccentric shaft 25, the actuating element 29 is disposed so as to be fixed against rotation on the eccentric shaft 25 by means of a pin 30. The thread 33 provided on the eccentric shaft 25 serves to apply a preloading between the clamping nut 31 and a washer 32, on the one hand, at one end and the snap ring 27, on the other hand, i.e., between the actuating lug 3*d* and the bearing plate 3*c* of the bearing body 3.

The foregoing is a description corresponding in substance to German Application P 41 17 094.6, dated May 25, 1991, the International priority of which is being claimed for the instant application, and which is hereby made part of this application. Any material discrepancies between the foregoing specification and the aforementioned corresponding German application are to be resolved in favor of the latter.

I claim:

1. Compressed air-fed turning bar assembly for turning over printed webs of material, comprising a cross member, a bearing body displaceably disposed on said cross member, at least one turning bar secured to said bearing body and displaceable therewith on said cross member, said turning bar having a circumference formed with air-outlet openings, at least one actuating spindle mounted in said turning bar and having an air duct, a piston displaceably mounted on said actuating spindle and having an outer cylindrical surface formed with air outlet openings disposed in rows of different length extending in axial direction of said piston, and means for feeding pressurized air from said cross member to said bearing body and into said air duct of said spindle.

2. Compressed air-fed turning bar according to claim 1, wherein said rows of air-outlet openings formed on said outer cylindrical surface of said piston ar laterally offset with respect to one another in accordance with respective edges of a web of material slung around said turning bar.

3. Compressed air-fed turning bar according to claim 1, including an electric motor connected to said actuating spindle for driving said spindle, said electric motor having a potentiometer.

4. Compressed air-fed turning bar according to claim 1, including a closed channel system for feeding compressed air into the interior of said turning bar, said closed channel system having an approximately identical cross-sectional area over the length thereof.

5. Compressed air-fed turning bar according to claim 1, including means for building up an air cushion by discharging air from said air duct of said actuating spindle starting from the middle of said turning bar.

6. Compressed air-fed turning bar according to claim 1, wherein said bearing body has a device for finely adjusting the angular position of said turning bar.

7. Compressed air-fed turning bar according to claim 6, wherein said fine-adjusting device comprises an eccentric shaft, and an eccentric movable by said eccentric shaft in a chamber formed in said bearing body, said bearing body comprising an actuating lug and a bearing plate, said actuating lug being displaceable by said eccentric shaft relative to said bearing plate.

* * * * *